US007031647B2

(12) United States Patent
Mishra et al.

(10) Patent No.: US 7,031,647 B2
(45) Date of Patent: Apr. 18, 2006

(54) IMAGEABLE SEAMED BELTS WITH LIGNIN SULFONIC ACID DOPED POLYANILINE

(75) Inventors: Satchidanand Mishra, Webster, NY (US); Robert C. U. Yu, Webster, NY (US); Richard L. Post, Penfield, NY (US); Anthony M. Horgan, Pittsford, NY (US); Edward F. Grabowski, Webster, NY (US); Kathleen M. Carmichael, Williamson, NY (US); Satish R. Parikh, Rochester, NY (US); Bing R. Hsieh, Webster, NY (US); Donald C. VonHoene, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 70 days.

(21) Appl. No.: 10/825,453

(22) Filed: Apr. 14, 2004

(65) Prior Publication Data

US 2005/0232662 A1 Oct. 20, 2005

(51) Int. Cl.
*G03G 15/01* (2006.01)

(52) U.S. Cl. ..... 399/302; 399/162; 399/308

(58) Field of Classification Search ..... 399/159, 399/162, 302, 308, 309, 303, 312; 252/500, 252/521.1, 515.1; 430/56, 57, 48, 126; 428/411.1, 428/323, 327, 421, 422

See application file for complete search history.

(56) References Cited

U.S. PATENT DOCUMENTS

| | | | | |
|---|---|---|---|---|
| 5,382,486 | A * | 1/1995 | Yu et al. | 430/56 |
| 5,968,417 | A | 10/1999 | Viswanathan | 252/500 |
| 6,531,227 | B1 * | 3/2003 | van den Reek et al. | 428/411.1 |
| 6,764,617 | B1 * | 7/2004 | Viswanathan et al. | 252/500 |
| 2005/0233229 | A1 * | 10/2005 | Yu et al. | 430/56 |
| 2005/0233230 | A1 * | 10/2005 | Carmichael et al. | 430/56 |

FOREIGN PATENT DOCUMENTS

JP 2001-305884 * 11/2001

* cited by examiner

*Primary Examiner*—Hoan Tran
(74) *Attorney, Agent, or Firm*—Annette L. Bade

(57) ABSTRACT

A belt having a substrate with a first binder and a lignin sulfonic acid doped polyaniline dispersion, along with an image forming apparatus for forming images on a recording medium and having a charge-retentive surface to receive an electrostatic latent image thereon, a development component to apply toner to the charge-retentive surface to develop the electrostatic latent image to form a developed toner image on the charge retentive surface, a transfer member to transfer the developed image from the charge retentive surface to a copy substrate, and the transfer member has a substrate with a binder and a dispersion of lignin sulfonic acid doped polyaniline, and further, a fixing component to fuse the developed image to the copy substrate.

19 Claims, 5 Drawing Sheets

IMAGEABLE SEAMED BELTS WITH LIGNIN SULFONIC ACID DOPED POLYANILINE

CROSS-REFERENCE TO RELATED APPLICATIONS

Reference is made to commonly-assigned, co-pending U.S. patent application Ser. No. 10/825,450, filed Apr. 4, 2004, entitled, "Photosensitive Member Having Anti-Curl Backing Layer with Lignin Sulfonic Acid Doped Polyaniline," and co-pending U.S. patent application Ser. No. 10/824,794, filed Apr. 4, 2004, entitled, "Photosensitive Member Having Ground Strip with Lignin Sulfonic Acid Doped Polyaniline." The disclosures of these commonly assigned applications being hereby incorporated by reference in their entirety.

BACKGROUND

Herein is disclosed, an intermediate transfer member, which, in belt form, can be seamed or seamless. The intermediate transfer member can be used in electrostatographic, such as xerographic, image on image, digital, and the like machines. In embodiments of a seamed belt, an image can be transferred at the seam of the belt with little or no print defects caused by the seam. In embodiments, xerographic component imageable seamed intermediate transfer belts comprising an electrically conductive filler dispersed in a binder are disclosed. In an embodiment, the binder is a polymer and the conductive filler is lignin sulfonic acid doped polyaniline. In embodiments, seaming of the belt can be formed by solvent or ultrasonic welding or by adhesive bonding. In embodiments, the problem of steep rise in conductivity with doping levels can be avoided or effectively be suppressed and process control is more robust. Also, in embodiments, glue and/or tape are not necessary to seam the belt, and the belt can be made by ultrasonic welding.

In a typical electrostatographic reproducing apparatus such as an electrophotographic imaging system using a photosensitive member, a light image of an original to be copied is recorded in the form of an electrostatic latent image upon a photosensitive member and the latent image is subsequently rendered visible by the application of a developer mixture. One type of development system used in such xerographic imaging machines is a dry developer comprising carrier beads, toner particles, charge control agents, and having lubricant particles mixed therein. Generally, the toner is made up of thermoplastic resin and a suitable colorant such as a dye or pigment. The developer material is brought into contact with the electrostatic latent image formed upon the photosensitive imaging member and the colored toner particles are deposited thereon in image configuration.

The developed toner image recorded on the imaging member is transferred to an image receiving substrate such as paper via an intermediate transfer member. The toner particles may first be transferred by heat and/or pressure to an intermediate transfer member, or more commonly, the toner image particles may be electrostatically transferred to the intermediate transfer member by means of an electrical potential between the imaging member and the intermediate transfer member. After the toner has been transferred to the intermediate transfer member, it is then transferred to the image receiving substrate, for example, by contacting the substrate with the toner image on the intermediate transfer member under heat and/or pressure, or alternatively by electrostatic attraction.

Transfer members enable high throughput at modest process speeds. In four-color photocopier or printer systems, the transfer member also improves registration of the final color toner image. In such systems, the four component colors of cyan, yellow, magenta and black may be synchronously developed onto one or more imaging members and transferred in registration onto a transfer member at a transfer station.

In electrostatographic printing and photocopy machines in which the toner image is transferred from the intermediate transfer member to the image receiving substrate, it is desired that the transfer of the toner particles from the intermediate transfer member to the image receiving substrate be substantially 100 percent. Less than complete transfer to the image receiving substrate results in image degradation and low resolution. Complete transfer is particularly desirable when the imaging process involves generating full color images since undesirable color deterioration in the final colors can occur when the color images are not completely transferred from the intermediate transfer member.

Thus, it is desirable that the intermediate transfer member surface has excellent release characteristics with respect to the toner particles. Conventional materials known in the art for use as transfer members often possess the strength, conformability and electrical conductivity necessary for use as transfer members, but can suffer from poor toner release characteristics, especially with respect to higher gloss image receiving substrates.

Polyimide substrate transfer members are suitable for high performance applications because of their outstanding mechanical strength and thermal stability, in addition to their good resistance to a wide range of chemicals. However, the high cost of manufacturing seamless polyimide belts has led to the introduction of a seamed belt. Polyimides with the best mechanical and chemical properties often exhibit poor adhesion at the seam even when commercially available primers are used. Further, polyimide materials exhibit relatively high surface energy and high friction, which decrease toner transfer efficiency in transfix and transfuse applications. In order to have high toner transfer efficiency, higher electric fields are typically required to transfer the toner and various costly cleaning apparatuses are employed to remove residual toner that does not transfer. In addition, substrates used for present imageable seamed intermediate transfer belt fabrication such as polyimides have high surface resistivity, which reduces the electrical latitude of the bonding adhesives used for seam joining and causes toner disturbance. Meanwhile, the seam rupture strength of these imageable seams can be relatively low due to superfinishing polish of the seam bonding area. These seams are fragile and may be easily damaged if mishandled.

Many of the above problems have been solved by the introduction of a polyimide belt having carbon black and polyaniline fillers dispersed therein. However, this belt, although preferred in terms of function, cannot be prepared by using the convenient ultrasonic seam welding process. The belt fabrication, therefore, employs a puzzle-cut joint. By itself, the puzzle-cut joint does not have strength to hold the belt together as the belt flexes and bends over the rollers of a belt support module during dynamic belt cycling under a normal machine service condition. It is therefore, required to use glue or adhesive, which is applied in the form of a tape either over or under the seam joint to permanently secure the puzzle-cut mating pairs and prevent the seam from disengaging during dynamic belt function in a machine. However, the application of a tape to permanently secure the puzzle-cut seam joint does add substantial thickness to the seam, which thereby has to undergo a time consuming and costly polishing process to reduce its thickness and provide a smooth finish.

Another serious problem of the extruded polyimide belt having polyaniline and carbon black fillers dispersed therein, is a very steep dependence of conductivity as a function of loading of polyaniline and carbon black. Belts, such as intermediate transfer belts, require a rather tight window of bulk resistivity. The result is difficulty with quality and manufacturing control, including dark-light petals on prints due to the inherent difficulty for providing excellent electrical property matching between the applied seam bonding adhesive and the bulk of the polyimide belt.

U.S. Pat. No. 5,549,193 relates to an endless flexible seamed belt comprising puzzle cut members, wherein at least one receptacle has a substantial depth in a portion of the belt material at the belt ends.

U.S. Pat. No. 5,721,032 discloses a puzzle cut seamed belt having a strength-enhancing strip.

U.S. Pat. No. 5,487,707 discloses a puzzle cut seamed belt having a bond between adjacent surfaces, wherein an ultraviolet cured adhesive is used to bond the adjacent surfaces.

U.S. Pat. No. 5,514,436 relates to a puzzle cut seamed belt having a mechanically invisible seam, which is substantially equivalent in performance to a seamless belt.

U.S. Pat. No. 5,525,446 describes an intermediate transfer member including a base layer and top thermoplastic film forming polymer layer. The base layer can include a polycarbonate film, and the top layer can include polybutylenes. The belt can comprise an adhesive layer such as a polyvinylbutyral adhesive layer.

It is desired to provide an intermediate transfer member wherein, in belt form, the belt can be formed by solvent welding or ultrasonic welding. It is further desired to provide a seamed belt wherein glue and/or tape are not required to seam the belt. It is also desired to provide an intermediate transfer member in which the problem of steep rise in conductivity with doping levels can be suppressed or eliminated.

SUMMARY

Embodiments include an image forming apparatus for forming images on a recording medium comprising a charge-retentive surface to receive an electrostatic latent image thereon, a development component to apply toner to the charge-retentive surface to develop the electrostatic latent image to form a developed toner image on the charge retentive surface, an intermediate transfer belt to transfer the developed toner image from the charge retentive surface to a copy substrate, wherein the intermediate transfer belt comprises a substrate comprising a first binder and lignin sulfonic acid doped polyaniline dispersion, and a fixing component to fuse the developed toner image to the copy substrate.

In addition, embodiments include a belt comprising a substrate comprising a first binder and a lignin sulfonic acid doped polyaniline dispersion.

Moreover, embodiments include an image forming apparatus for forming images on a recording medium comprising a charge-retentive surface to receive an electrostatic latent image thereon; a development component to apply toner to the charge-retentive surface to develop the electrostatic latent image to form a developed toner image on the charge retentive surface; an intermediate transfer belt to transfer the developed toner image from the charge retentive surface to a copy substrate, wherein the intermediate transfer belt comprises a substrate comprising a polyimide and a lignin sulfonic acid doped polyaniline dispersion; and a fixing component to fuse the developed toner image to the copy substrate.

BRIEF DESCRIPTION OF THE DRAWINGS

For a better understanding of the present invention, reference may be had to the accompanying figures.

DETAILED DESCRIPTION

In embodiments, the transfer member is an intermediate transfer member such as a belt, sheet, roller, or film useful in xerographic, including digital, image on image, and the like, apparatuses. However, the belts herein having a lignin sulfonic acid-doped polyaniline (hereinafter referred to as "Ligno-PANi") filler dispersed in a binder, can be useful as belts, rollers, drelts (cross between drum and belt formed by mounting a flexible belt over a rigid drum), and the like, for many different processes and components such as transfer members, intermediate transfer members, and the like. Further, the belts, herein, can be used for both liquid and powder xerographic architectures.

Figure 1:
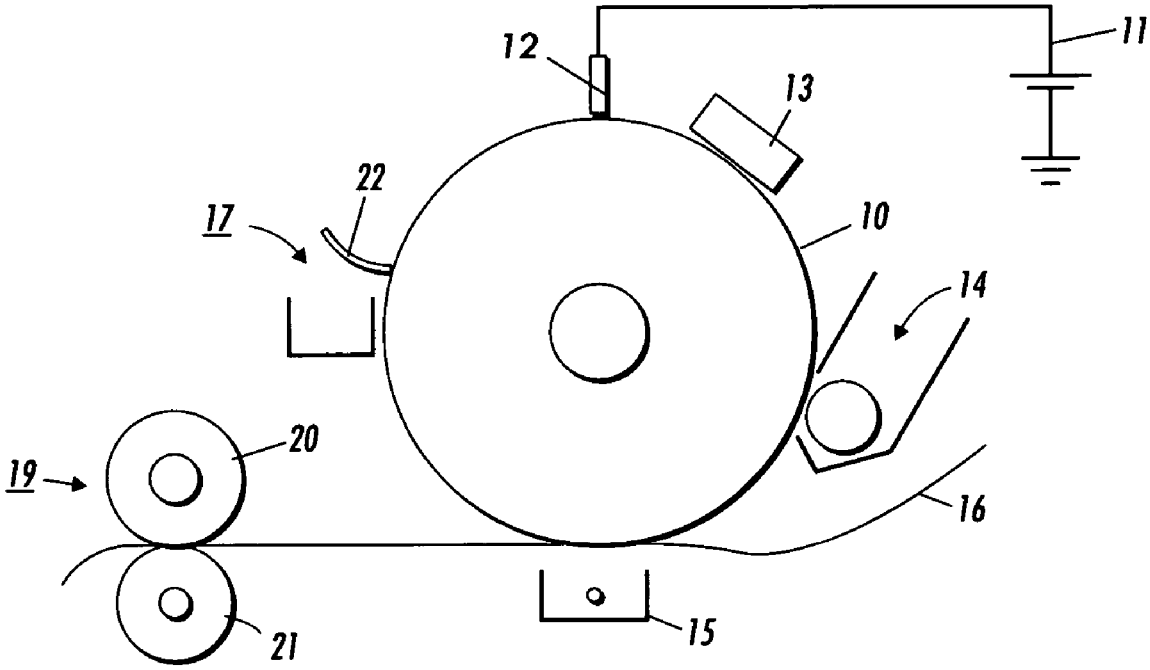
FIG. 1 is a depiction of an electrostatographic apparatus.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor 10 is then image wise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface of photoreceptor 10, in image configuration, they are transferred to a copy sheet 16 by transfer means 15, which is electrostatic transfer or can otherwise be pressure transfer. Alternatively, the developed image can first be transferred to an intermediate transfer member (not shown) and then subsequently transferred to copy sheet 16.

After the transfer of the developed image is completed, copy sheet 16 advances to fusing station 19, depicted in FIG. 1 as heat fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
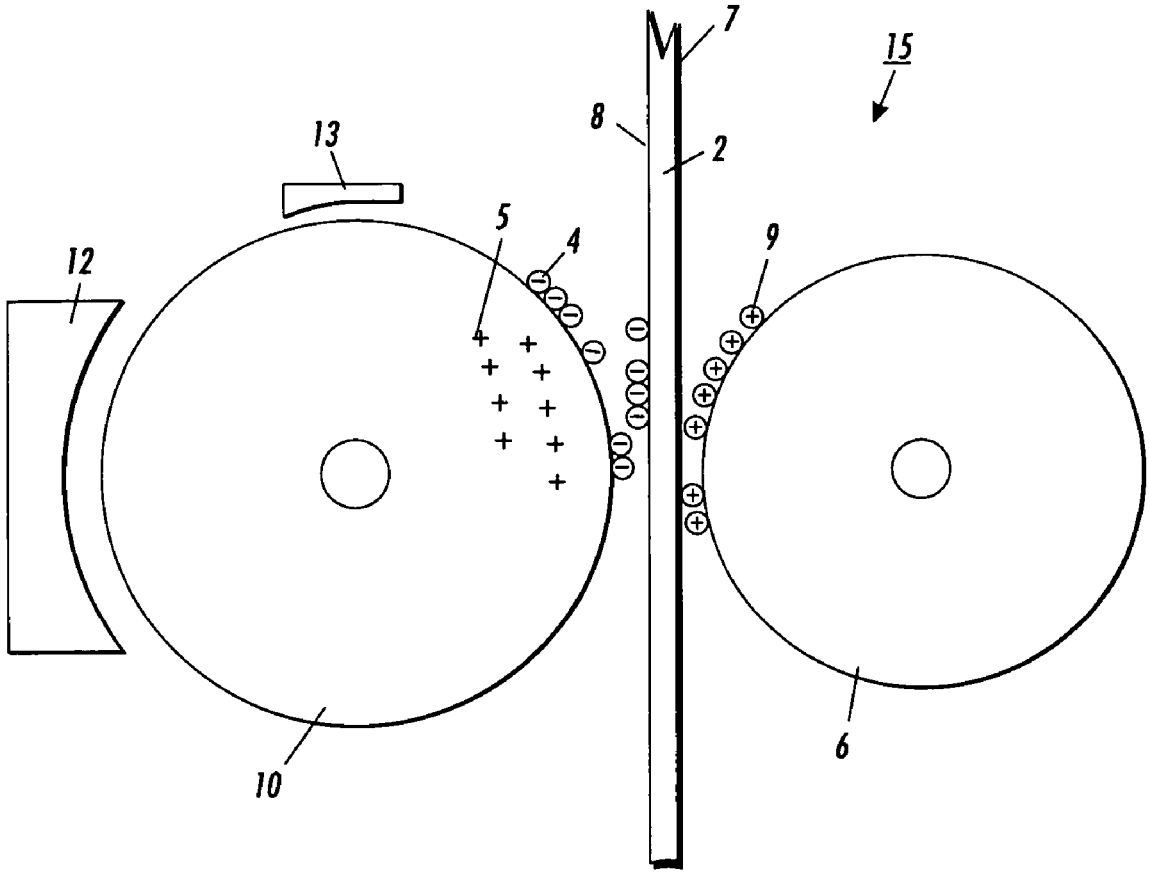
FIG. 2 is an enlargement of an embodiment of a transfer system including an intermediate transfer belt.

FIG. 2 is a schematic view of an image development system containing an intermediate transfer member. FIG. 2 demonstrates another embodiment and depicts a transfer apparatus 15 comprising an intermediate transfer member 2 positioned between an imaging member 10 and a transfer roller 6. The imaging member 10 is exemplified by a photoreceptor drum. However, other appropriate imaging members may include other electrostatographic imaging receptors such as ionographic belts and drums, electrophotographic belts, and the like.

In the multi-imaging system of FIG. 2, each image being transferred is first formed as a latent image on the imaging drum by image forming station 12. Each of these images is then developed into a toner image at developing station 13 and transferred to intermediate transfer member 2. In an alternative method, each image may be formed on the photoreceptor drum 10, developed, and transferred in registration to the intermediate transfer member 2. The multi-image system may be a color copying system. In the color copying system, each color of an image being copied is formed on the photoreceptor drum. Each color image is developed and transferred to the intermediate transfer member 2. As above, each of the colored images may be formed on the drum 10 and developed sequentially and then transferred to the intermediate transfer member 2. In the alternative method, each color of an image may be formed on the photoreceptor drum 10, developed, and transferred in registration to the intermediate transfer member 2.

After latent image forming station 12 has formed the latent image on the photoreceptor drum 10 and the latent image of the photoreceptor has been developed at developing station 13, the charged toner particles 4 from the developing station 13 are attracted and held by the photoreceptor drum 10 because the photoreceptor drum 10 possesses a charge 5 opposite to that of the toner particles 4. In FIG. 2, the toner particles are shown as negatively charged and the photoreceptor drum 10 is shown as positively charged. These charges can be reversed, depending on the nature of the toner and the machinery being used. In an embodiment, the toner can also be present in a liquid developer. However, in embodiments, it is useful for dry development systems.

A biased transfer roller 6 positioned opposite the photoreceptor drum 10 has a higher voltage than the surface of the photoreceptor drum 10. As shown in FIG. 2, biased transfer roller 6 charges the backside 7 of intermediate transfer member 2 with a positive charge. In an alternative embodiment of the invention, a corona or any other charging mechanism may be used to charge the backside 7 of the intermediate transfer member 2.

The negatively charged toner particles 4 are attracted to the front side 8 of the intermediate transfer member 2 by the positive charge 9 on the backside 7 of the intermediate transfer member 2.

Figure 3:
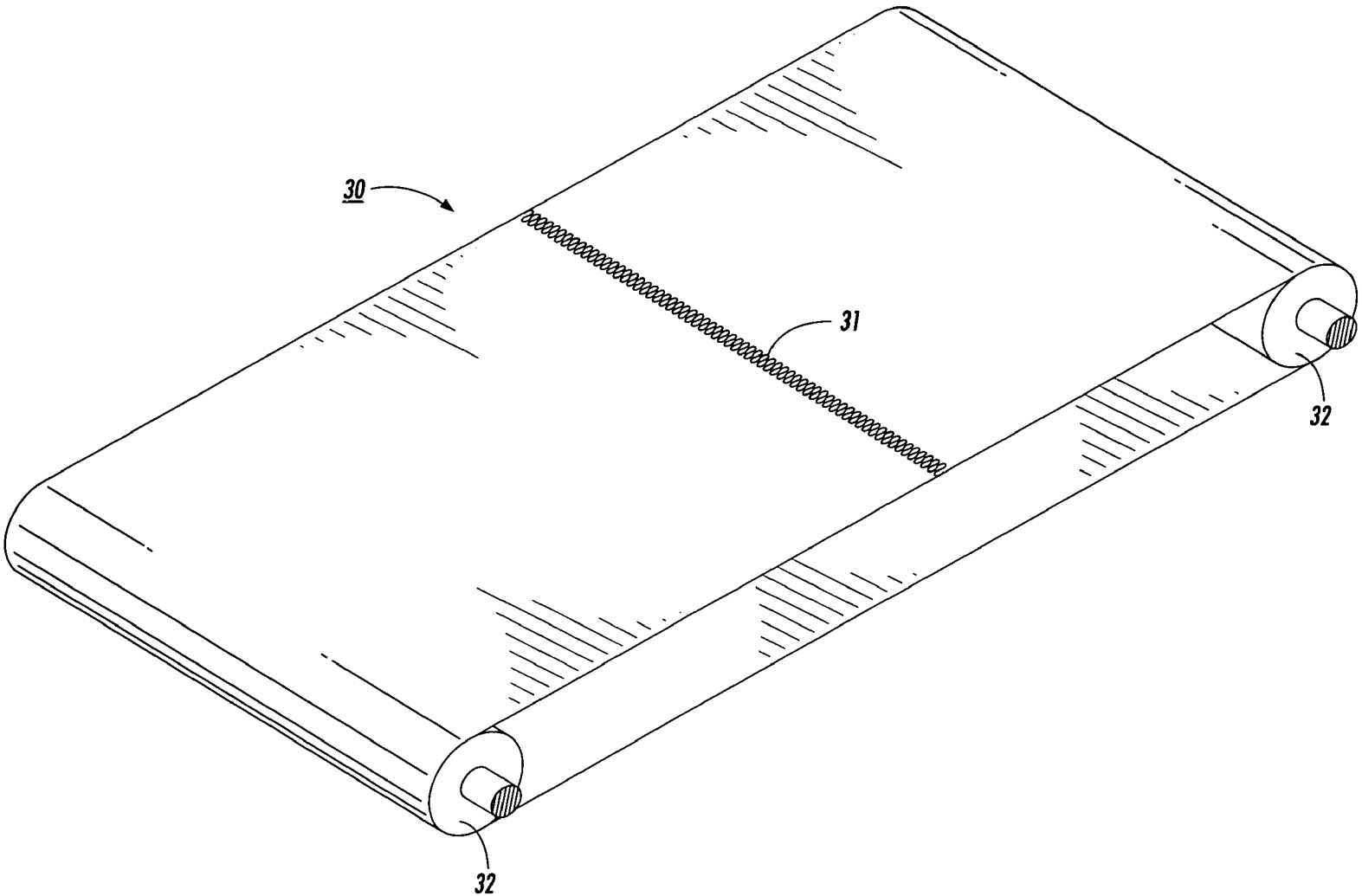
FIG. 3 is an enhanced view of an embodiment of a belt configuration and seam.

FIG. 3 demonstrates an example of an embodiment of an intermediate transfer belt 30. Belt 30, demonstrated with seam 31, is encircled around and supported by a bi-roller belt support module. Seam 31 is pictured as an example of one embodiment of a puzzle cut seam. The belt is held in position and turned by use of rollers 32 of the belt support module. Note that the mechanical interlocking relationship of the seam 31 is present in a two-dimensional plane when the belt 30 is on a flat surface, whether it be horizontal or vertical. While the seam is illustrated in FIG. 3 as being perpendicular to the two parallel sides of the belt, it should be understood that it may also be angled or slanted with respect to the parallel sides. This enables any noise generated in the system to be distributed more uniformly and the forces placed on each mating element or node to be reduced.

In embodiments, the belt herein can be a seamed or seamless belt. In an embodiment wherein the belt is seamed, the seam formed is one having a thin and smooth profile, of enhanced strength, improved flexibility and extended mechanical life, as well as having matching conductivity with the bulk of the belt to ensure electrical continuity for effective imageability. In an embodiment, the belt ends can be held together by the geometric relationship between the ends of the belt material, which are fastened together by a puzzle cut. Alternatively, overlapping, interlocking seam members can be present. The puzzle cut seam can be of many different configurations, but is one in which the two ends of the seam interlock with one another in a manner of a puzzle pattern of nil added seam thickness. Specifically, in embodiments, the mutually mating elements comprise a first projection and a second receptacle geometrically oriented so that the second receptacle on the first end receives the first projection on the second end and wherein the first projection on the first end is received by the second receptacle on the second end. The seam has a kerf, void or crevice between the mutually mating elements at the two joining ends of the belt, and that crevice can be filled with an adhesive according to the present invention. The opposite surfaces of the puzzle cut pattern are bound or joined together to enable the seamed flexible belt to essentially function as an endless belt. The belt, in embodiments, provides improved seam quality and smoothness with substantially no thickness differential between the seam and the adjacent portions of the belt.

In embodiments, the height differential between the seam and the rest of the belt (the nonseamed or bulk portions of the belt) is practically nil, or from about 0 to about 25 micrometers, or from about 0.0001 to about 10 micrometers, or from about 0.01 to about 5 micrometers. In embodiments, any height difference between the seam and the nonseamed adjacent, if exists, can be tapered and not abrupt, and can be ultrasonically or solvent welded.

Figure 4:
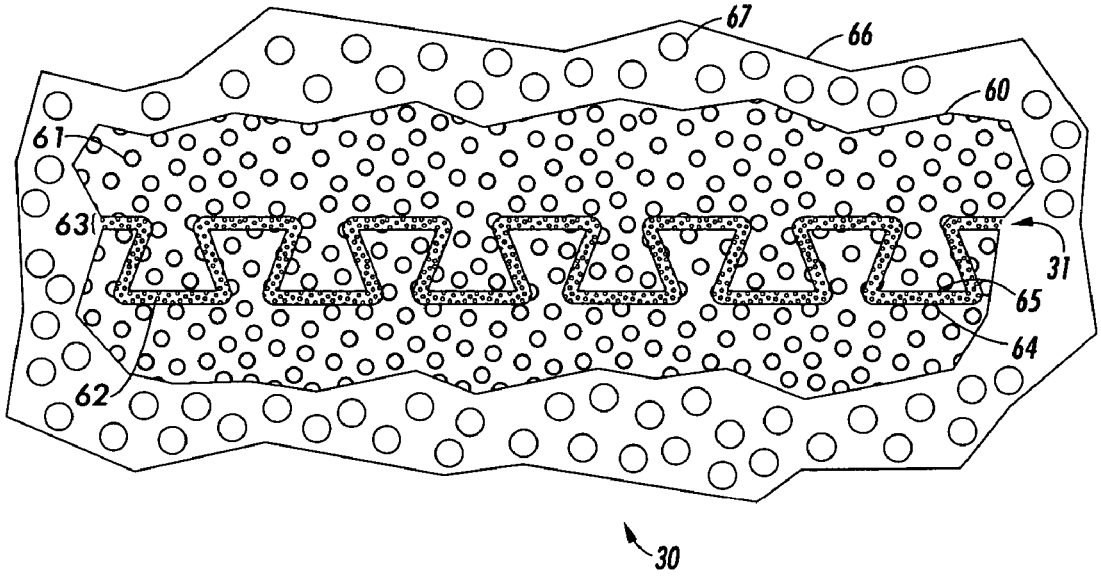
FIG. 4 is an enlarged sectional overhead view of an embodiment of a belt showing dispersion of fillers in the adhesive and substrate.

An example of a belt used is depicted in FIGS. 3 and 4. The puzzle-cut seamed belt 30 comprises a substrate 60 (shown accordingly in FIG. 4), having therein, in embodiments, dispersion of Ligno-PANi fillers 61. Referring to FIG. 4, the seamed belt 30, in embodiments, contains seam 31 having an adhesive 63 positioned and filled the kerf or crevice 63 between the seam members 64 and 65 of the mating ends of the belt to produce an adhesive bonded seam joint. The dimension of the seam crevice, in embodiments, can be typically between about 25 and about 35 micrometers. In an embodiment, conductive fillers 62 (such as Ligno-PANi) are dispersed or contained in the adhesive. Although any suitable kind of conductive fillers 62 may be used, Ligno-PANi can be the filler dispersion in the adhesive. An optional overcoat 66, if desired, can be provided over the substrate 60 and seam 31. The overcoat may contain conductive fillers 67. Conductive fillers 61 optionally dispersed or contained in the substrate, fillers 67 optionally dispersed or contained in the overcoat, and fillers 62 optionally contained or dispersed in the adhesive can be the same or different and may include Ligno-PANi.

Figure 5:
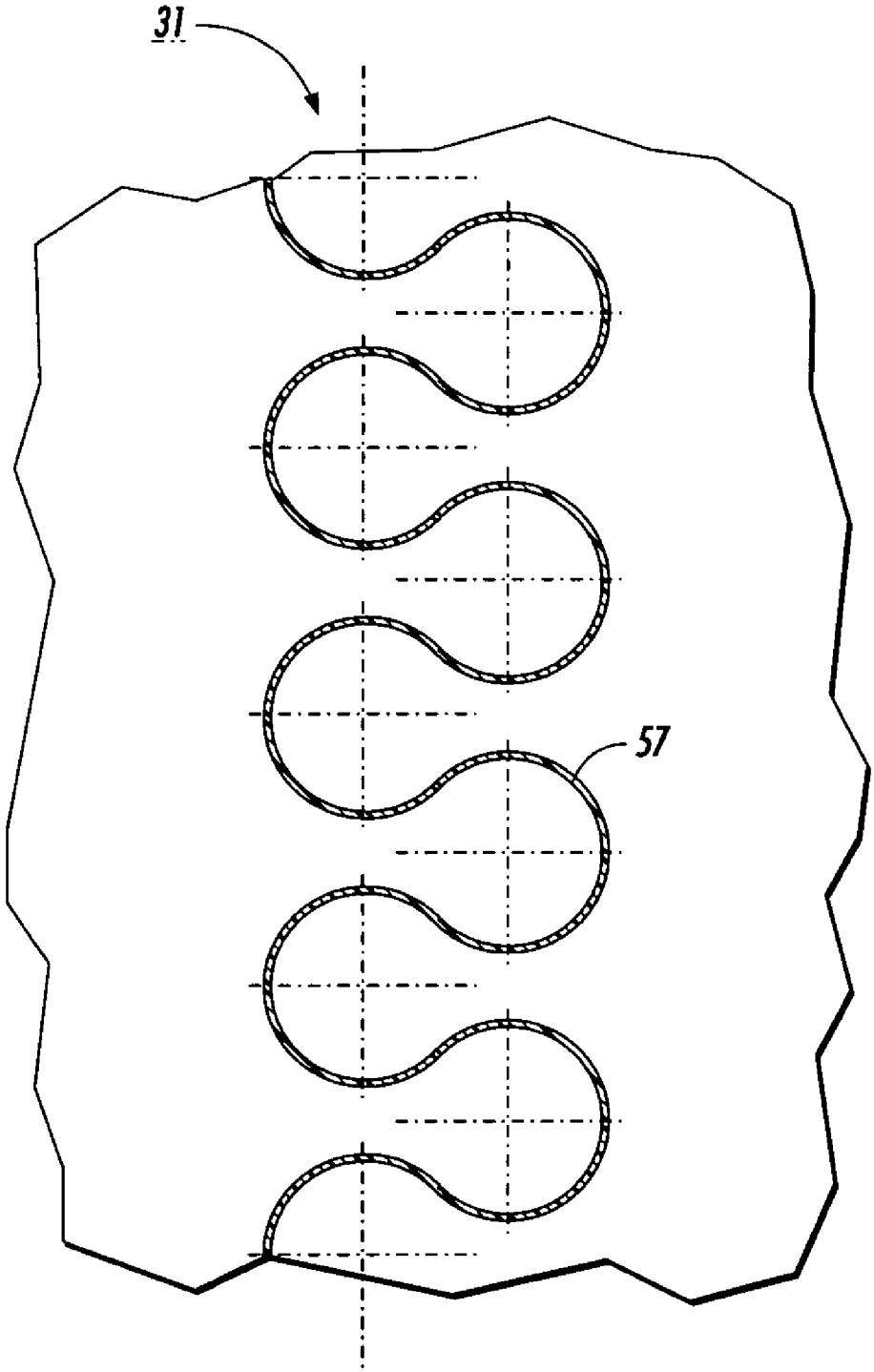
FIG. 5 is an enlarged sectional overhead view of another embodiment of a belt showing a puzzle cut seam.

In a seamed belt embodiment, an adhesive can be present between the seams, and placed in the crevice between the puzzle cut members to give a thickness of from about 0.0001 to about 50 micrometers. The thickness of the adhesive bonded seam is required to be further reduced to give nil thickness through an added super finishing mechanical polished process to meet the physical and electrical continuity requirement for imageable seam function. As shown in one embodiment having an alternate puzzle cut seam 31, the adhesive is present between the puzzle cut members and filled the seam crevice 57 of FIG. 5.

A variety of adhesives can be used. Examples of suitable second binders in the adhesives include fluoropolymer adhesives and polyurethane adhesives such as fluorinated urethanes (for example, fluoroethylene vinyl ether based polyurethanes, fluorinated epoxy polyurethane, fluorinated acrylic polyurethanes, and the like); copolyester adhesives; polyvinylbutyral adhesives; epoxy adhesives; polyimide adhesives such as polyaniline filled polyimide; polyamide adhesives such as DHTBD filled LUCKAMIDE®; and other high temperature adhesives such as nitrile phenolic, and the like. These polymers employed for adhesive formulation can be considered as the second binder. The adhesive formulation may include fillers such as polymer fillers, metal fillers, metal oxide fillers, carbon fillers, Ligno-PANi, and other fillers dispersed or contained in the second binder.

In a seamed belt fabrication embodiment, the belt may be prepared by filling an adhesive solution into the crevice between the substrate interlocking members by any suitable means such as using a cotton tipped applicator, liquid dispenser, glue gun and other known means. Alternatively, the adhesive may comprise a film forming thermoplastic polymer binder which is a solid layer introduced to the mating puzzle-cut ends by application of heat/compression process on the adhesive strip to thereby forcing the adhesive to flow and fill the crevice to bond the seam. The adhesive is placed between seaming members and the seaming members are brought together and bonded using known methods, and other methods such as that described in copending U.S. patent application Ser. No. 09/833,964 filed Apr. 11, 2001, entitled, "Flashless Hot Melt Bonding of Adhesives for Imageable Seamed Belts." The disclosure of this reference is hereby incorporated by reference herein in its entirety.

An optional outer layer can be placed over the web stock prior to belt fabrication, or an optional intermediate layer placed over the web stock. In another seamed belt embodiment, the outer layer may be applied only to the seamed region of the belt using a variety of common coating processes such as roll coating, gap coating, spray coating, dip coating, flow coating, and the like. Alternatively, lamination process may be employed to apply an outer layer to the web stock or a belt.

In embodiments, the belt is not seamed.

The belt comprises a first binder having Ligno-PANi-fillers dispersed therein.

The first binder can be a suitable polymer having sufficient strength to be used in a machine, requiring numerous revolutions around rollers. Examples of suitable polymers include polycarbonate, polyvinyl chloride, polyethers (such as polyethersulfone, polyether ether ketone, and the like), polyalkylenes such as polyethylenes (such as polyethylene terephthalate, polyethylene naphthalate, polyethylene terephthalate glycol (PETG), poly(1,4-cyclohexylenedimethylene terephthalate, and the like), polystyrene, polyacrylate, polyurethane, polyphenylene sulfide, polyimide (such as polyamide imide, and such as those commercially available as KAPTON®, KJ KAPTON®, and UPILIEX® both from DuPont, IMIDEX® from Westlake Plastics, and ULTEM® from GE), and the like, and mixtures thereof.

The polycarbonate first binder, in embodiments, may be a bisphenol A polycarbonate material such as poly(4,4'-isopropylidene-diphenylene carbonate) having a molecular weight of from about 35,000 to about 40,000, available as LEXAN 145 from General Electric Company and poly(4,4'-isopropylidene-diphenylene carbonate) having a molecular weight of from about 40,000 to about 45,000, available as LEXAN 141 also from the General Electric Company. A bisphenol A polycarbonate resin having a molecular weight of from about 50,000 to about 120,000 is available as MAKROLON from Farben Fabricken Bayer A.G. A lower molecular weight bisphenol A polycarbonate resin having a molecular weight of from about 20,000 to about 50,000 is available as MERLON from Mobay Chemical Company. Other types of polycarbonates of interest are poly(4,4-diphenyl-1,1'-cyclohexane carbonate) and poly(4,4'-isopropylidene-3,3'-dimethyl-diphenyl carbonate), both being film forming thermoplastic polymers. These last two polycarbonates are structurally modified from bisphenol A polycarbonate. They are commercially available from Mitsubishi Chemicals.

Polymer binders such as these listed above are thermoplastic, and can be extruded into a web then cut to proper size sheets for belt fabrication, but some are soluble in common organic solvents or solvent mixtures. Therefore, for those binders that can be dissolved in a solvent, the belt can conveniently be formed by solvent welding the two ends of the cut sheet into a seamed belt. These ends can be cut into any suitable form of a matching pair such as a puzzle-cut or skive-cut. The solvent weld technique gives a superior bonding of materials. Thermoplastic polyimide such as KJ KAPTON® and IMIDEX®, are polymers with increased mechanical and thermal properties. These polymers are totally insoluble in organic solvents, but can be extrudable in a web stock and then fabricated into belts by ultrasonic seam welding.

Ligno-PANi are conductive particles that can be conveniently incorporated by dispersion into a polymer binder, such as one listed above to render desirable web stock conductivity. The advantages include the ease of dispersion into the polymer binder material matrix for web stock preparation to give seamed and seamless belts that exhibit a less steep dependence of conductivity on the concentration of fillers. Other advantages include the lack of a need for tape or glue adhesives. In addition, advantages include that the belt can be solvent or ultrasonically welded.

The details of Ligno-PANi are described in literature, including U.S. Pat. No. 5,968,417, the entire disclosure thereof being herein incorporated by reference. In simple language, Ligno-PANi are conductive particles, each comprising polyaniline chains grafted to sulfonated lignin. Ligno-PANi are lignin sulfonic acid doped polyanilines which may be prepared in a laboratory by passing an aqueous solution of lignin sulfonic acid, ethoxylated, sodium salt through a protonated Dowex-HCR-W2 cation ion exchange column to give lignin sulfonic acid, which is further reacted with aniline to produce anilinium lignin sulfonate salt, and then finally oxidatively polymerized in the presence of ammonium persulfate to form a green colored powder of electrically conducting lignin sulfonic acid doped polyaniline.

Ligno-PANi is a lignin sulfonic acid doped polyaniline. Lignin is a principal constituent of wood structure of higher plants. Lignin comprises structure from the polymerization of both coniferyl alcohol and sinapyl alcohol. Lignin may also comprise functional groups such as hydroxy, methyoxy, and carboxy groups. Lignosulfonates are sulfonated lignins or polyaryl-sulfoniac acids that are highly soluble in water. Lignosulfonates can be used as dispersants, binders, emulsion stabilizers, complexing agents, and other applications. The aryl rings of lignin sulfonate polymers may comprise a variety of functional groups such as hydroxy, methoxy and carboxy groups that can be crosslinked after polymerization. Also, ligninsulfonates comprise multiple sulfonic acid groups that can be used for doping polymers. Ligno-PANi is a redox active, highly dispersible, cross-linkable filler and can be incorporated into a wide range of binders. Ligno-PANi is available commercially from NASA. Sulfonated polyaryl compounds can be attached to linearly conjugated π-systems by ionic or covalent bonds, as well as through electrostatic interactions such as hydrogen bonds. The molecular weight of Ligno-PANi may be from about 5,000 to about 200,000, or from about 10,000 to about 100,000, or from about 15,000 to about 50,000. Dispersed in a variety of polymers, Ligno-PANi can be either web-coated or extruded. The Ligno-PANi dispersion preparation has an average particle size of between about 1.9 and about 2.5-micrometer diameter when approximated as spherical in particle shape. However, smaller Ligno-PANi particle size below this range, if desired, can be obtained by using particle classification technique.

In embodiments, Ligno-PANi has the following Formula I:

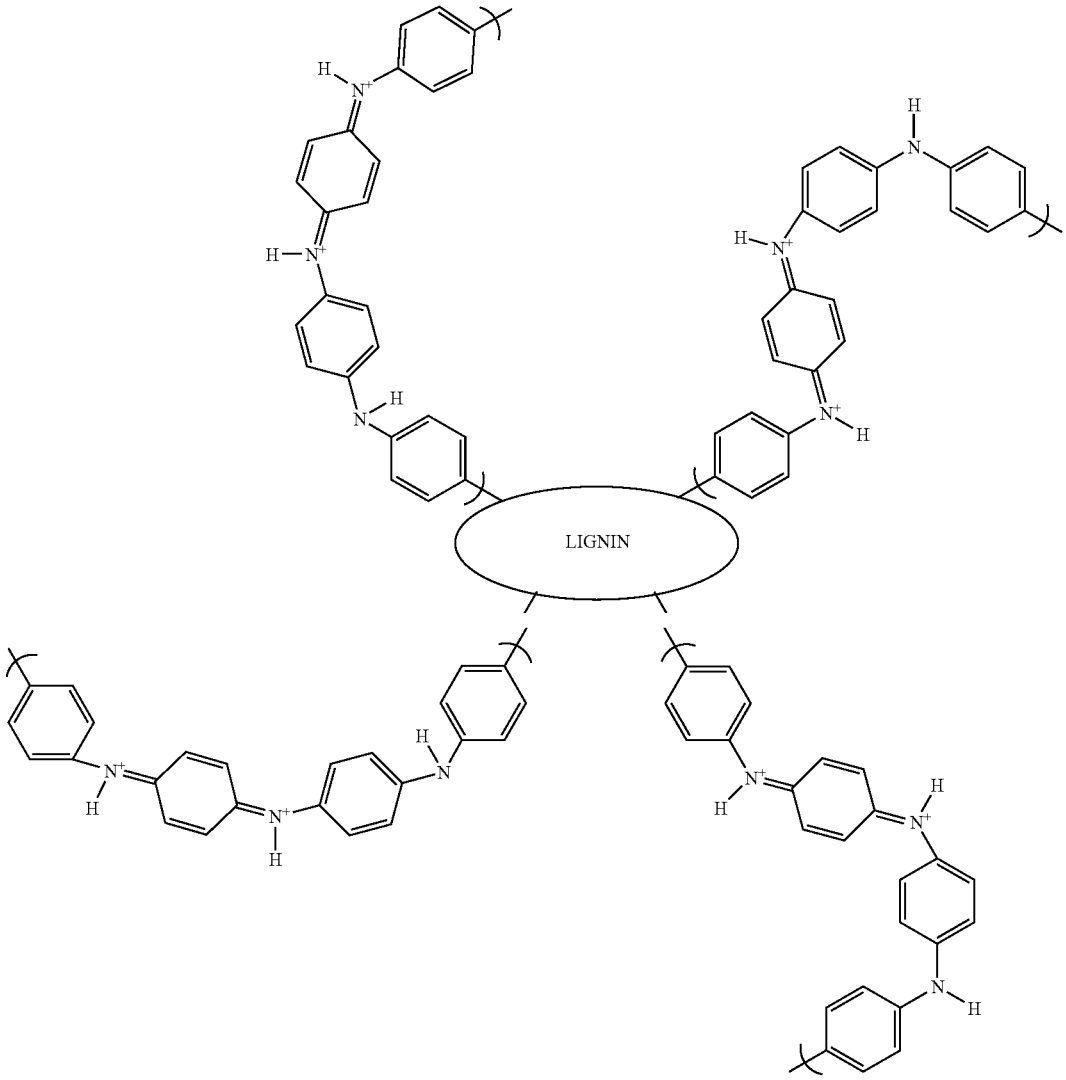

In other embodiments, Ligno-PANi has the following Formula II:
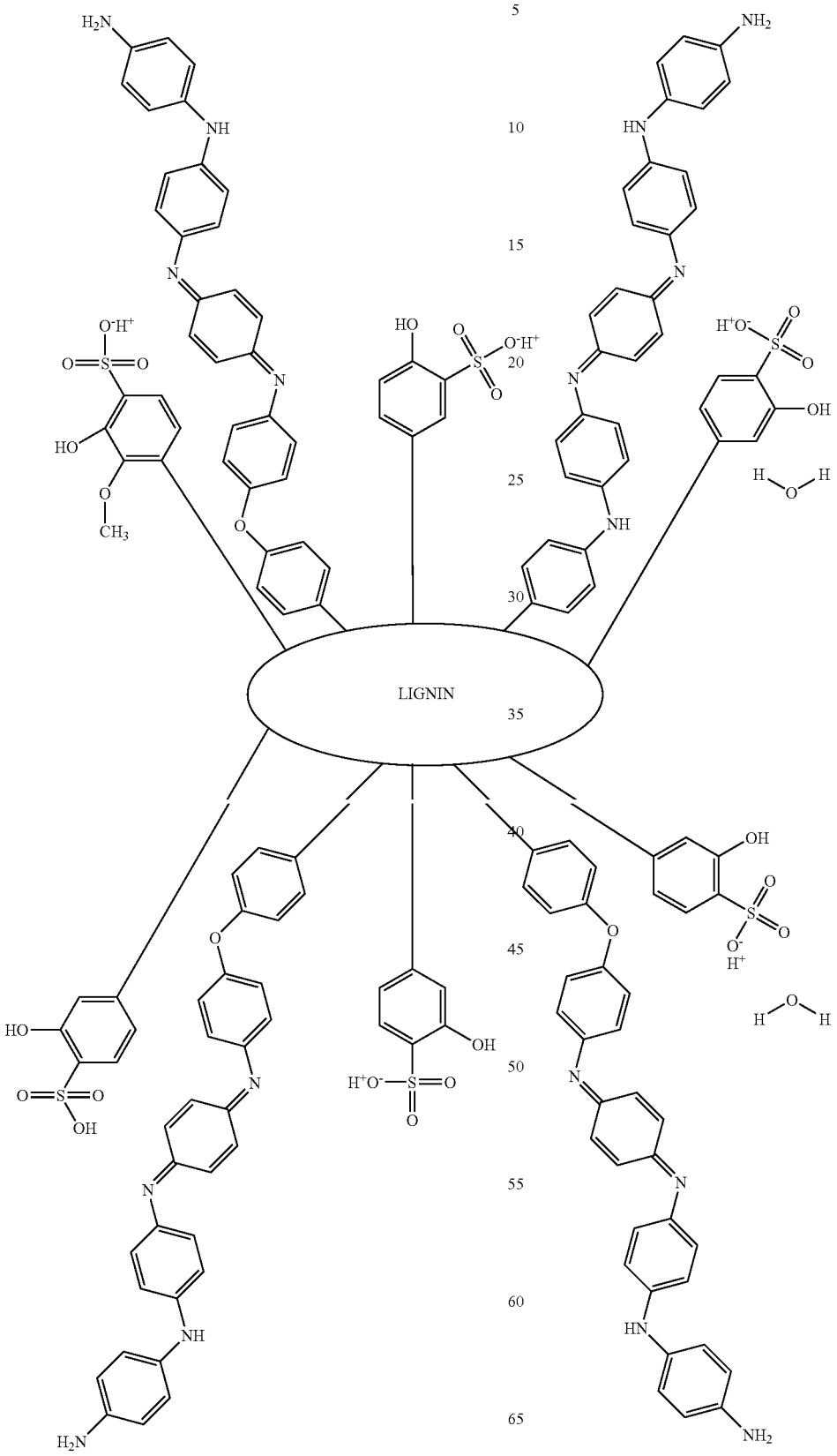

A surface resistivity range for toner transfer performance, based on a belt having 80 microns in thickness, can be from about $10^2$ to about $10^{15}$ ohm/sq, or from about $10^8$ to about $10^{14}$ ohm/sq. The surface resistivity for toner transfer performance can be from about $10^8$ to about $10^{12}$ ohm/sq, or from about $10^{10}$ to about $10^{11}$ ohm/sq. In the case of seamed belts, when the belt and the seam of the belt is formed to have the same or substantially the same electrical resistance, toner transfer at the seam is the same or substantially the same in efficiency as the transfer at the belt. Such transfer at the seam functions virtually as an invisible or substantially invisible seam in copy printouts.

Ligno-PANi is present as a dispersion in the polymer binder of the intermediate transfer member in an amount of from about 1 to about 50, or from about 5 to about 20, or from about 6 to about 10 percent by weight of total solids. Total solids, as used herein, refers to the amount of solids (such as binders, fillers, Ligno-PANi, and other solids) present in the substrate, layer, or adhesive. In the event that the seam of the belt is formed by adhesive bonding, Ligno-PANi dispersion can be present in the adhesive in an amount of from about 1 to about 50, or from about 5 to about 20, or from about 8 to about 10 percent by weight of total solids to provide effective electrical continuity.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Comparative Example Using Known Coating Layer

A flexible insulating substrate layer was prepared by firstly dissolving 10 grams of film forming Bisphenol A polycarbonate (poly(4,4'-isopropylidene-diphenylene carbonate having a molecular weight of about 120,000, commercially available from Farben Fabricken Bayer A.G. MAKROLON 5705), in 90 grams methylene chloride inside a glass container to give a 10 percent by weight solution. Secondly, this MAKROLON solution was applied over a 9 inch×12 inch biaxially oriented thermoplastic polyester support sheet (PET, MELINEX, available from ICI Americas Inc.) sheet, 10 mils (254 micrometers) in thickness, by following the standard hand coating procedures and using a 20-mil gap Bird applicator. Thirdly, the applied wet coating layer was then dried at 257° F. (125° C.) in a forced air oven to produce a resulting dry thickness of about 75 micrometers of a MAKROLON coating layer. The coated layer was easily released from the thick PET support sheet to provide an insulating MAKROLON substrate control.

Example 2

Preparation of Polycarbonate with Ligno-PANi Filler in Intermediate Transfer Belt Coating Four MAKROLON coating solutions were prepared by following the same procedures and identical materials as that described in Example 1, with the exception that various amount of Ligno-PANi (lignin sulfonic acid doped polyaniline conductive particles available from Seegott, Inc.) were dispersed to each solution with the use of a high shear blade mechanical dispersator, to give four homogeneous coating formulations. Each of these prepared coating formulations was applied, again by hand coating and using 20-mil gap Bird applicator, over four individual 9 inch×12 inch PET support sheets. After drying at elevated temperature of 257° F. (125° C.), they gave four levels of 5, 10, 20, and 30 weight percent Ligno-PANi dispersions in four respective semi-conductive MAKROLON coating substrates.

Example 3

Preparation of Polyimide with Ligno-PANi Filler Intermediate Transfer Belt Substrate Preparation of semi-conducting polyimide substrate may alternatively be made possible by carrying out the following procedures described below:

Dissolve Pyromellitic dianhydride (PMDA) in dimethyl acetamide (DMAc) to form a first solution;

Dissolve 4,4'-oxydianiline (ODA) in DMAc to form a second solution;

Mixing the first solution and the second solution to give a resulting solution;

Adding a pre-determined amount of Ligno-PANi to the resulting solution and with the use of a high shear blade mechanical dispersator to give a homogeneously dispersed pre-polymer solution; and Applying the prepared pre-polymer solution over a glass surface, followed by drying the wet coating at an elevated temperature reaching up to 300° C. to initiate imidization reaction, solidification, and curing of the coating. The result is a semi-conductive polyimide substrate for use in intermediate transfer belt application.

Example 4

Electrical Conductivity Testing of Polycarbonate and Ligno-PANi Filler in Intermediate Transfer Belt Coating The electrical conductivity (otherwise resistivity) of the four invention semi-conductive MAKRLON substrates, prepared according to the Examples 1 and 2 were measured along with the MAKROLON substrate control for comparison, using a Hiresta Device. The results obtained presented as surface resistivity, determined under an applied potential of 1,000 v and a 7 mm gap, are listed in Table 1 below.

TABLE 1

| MAKROLON Substrate Ligno-PANi Dispersion | Surface Resistivity ohms/sq |
|---|---|
| Control (0% wt) | $1.02 \times 10^{17}$ |
| 5% wt | $8.6 \times 10^{14}$ |
| 10% wt | $1.1 \times 10^{13}$ |
| 20% wt | $1.2 \times 10^{11}$ |
| 30% wt | $1.0 \times 10^{8}$ |

The data given in Table 1 above indicate that an electrical insulating film forming polymer, such as polycarbonate or polyimide or the like polymer binder, could easily be rendered conductivity by incorporation of Ligno-PANi dispersion in its polymer matrix. At varying weight percent of Ligno-PANi dispersion level in MAKROLON, MAKROLON with Ligno-PANi dispersion substrate could conveniently be brought into a desirable semi-conductivity range suitable for intermediate transfer belt (ITB) preparation. Furthermore, MAKROLON having a Tg of about 160° C. is a substrate acceptable for ITB application which is usually functioning under a typical machine toner image transferring and fusing temperature of about 120° C.

It is also worth mentioning that if machine toner image transferring and fusing processes require a higher temperature far beyond 120° C., Ligno-PANi loaded polyimide would work well.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An image forming apparatus for forming images on a recording medium comprising:

a charge-retentive surface to receive an electrostatic latent image thereon;

a development component to apply toner to said charge-retentive surface to develop said electrostatic latent image to form a developed toner image on said charge retentive surface;

an intermediate transfer member to transfer the developed toner image from said charge retentive surface to a copy substrate, wherein said intermediate transfer member comprises a substrate comprising a first binder and lignin sulfonic acid doped polyaniline dispersion, wherein said sulfonic acid doped polyaniline is present in the substrate in an amount of about 1 about 50 percent by weight of total solids; and a fixing component to fuse said developed toner image to said copy substrate.

2. An image forming apparatus in accordance with claim 1, wherein said lignin sulfonic acid doped polyaniline is present in the substrate in an amount of from about 5 to about 20 percent by weight of total solids.

3. An image forming apparatus in accordance with claim 2, wherein said lignin sulfonic acid doped polyaniline is present in the substrate in an amount of from about 6 to about 10 percent by weight of total solids.

4. An image forming apparatus in accordance with claim 1, wherein said first binder is a polymer selected from the group consisting of polycarbonate, polyimide, polyvinyl chloride, polyether, polystyrene, polyacrylate, polyurethane, polyalkylene, polyphenylene sulfide, and mixtures thereof.

5. An image forming apparatus in accordance with claim 4, wherein said first binder is a polyimide.

6. An image forming apparatus in accordance with claim 4, wherein said first binder is a polycarbonate material selected from the group consisting of poly(4,4'-isopropylidene-diphenylene carbonate), poly(4,4-diphenyl-1,1'-cyclohexane carbonate), poly(4,4'-isopropylidene-3,3'-dimethyl-diphenyl carbonate), and mixtures thereof.

7. An image forming apparatus in accordance with claim 1, wherein said intermediate transfer member has a surface resistivity of from about $10^2$ to about $10^{15}$ ohm/sq.

8. An image forming apparatus in accordance with claim 7, wherein said intermediate transfer member has a surface resistivity of from about $10^8$ to about $10^{14}$ ohm/sq.

9. An image forming apparatus in accordance with claim 1, wherein said intermediate transfer member is a seamless belt.

10. An image forming apparatus in accordance with claim 1, wherein said intermediate transfer member is a seamed belt.

11. An image forming apparatus in accordance with claim 10, wherein said transfer member comprises a first end and a second end, each of said first end and said second end comprising a plurality of mutually mating elements which join in an interlocking relationship to form a seam.

12. An image forming apparatus in accordance with claim 11, wherein said plurality of mutually mating elements are in the form of a puzzle cut pattern.

13. An image forming apparatus in accordance with claim 12, wherein said mutually mating elements comprise a first projection and a second receptacle geometrically oriented so that said second receptacle on the first end receives the first projection on the second end and wherein said first projection on said first end is received by said second receptacle on the second end to form a joint between the first and second ends.

14. An image forming apparatus in accordance with claim 10, wherein said seam comprises an adhesive.

15. An image forming apparatus in accordance with claim 14, wherein said adhesive comprises a second binder and lignin sulfonic acid doped polyaniline.

16. An image forming apparatus in accordance with claim 15, wherein said second binder is selected from the group consisting of copolyester, fluoropolymer, polyvinylbutyral, epoxy, polyimide, polyurethane, polyamide, nitrile phenolic, and mixtures thereof.

17. An image forming apparatus in accordance with claim 16, wherein said second binder is a polyamide.

18. A belt comprising a substrate comprising a first binder and a lignin sulfonic acid doped polyaniline dispersion, wherein said lignin sulfonic acid doped polyaniline is present in the substrate in an amount of from about 1 to about 50 percent by weight of total solids.

19. An image forming apparatus for forming images on a recording medium comprising:

a charge-retentive surface to receive an electrostatic latent image thereon;

a development component to apply toner to said charge-retentive surface to develop said electrostatic latent image to form a developed toner image on said charge retentive surface;

an intermediate transfer belt to transfer the developed toner image from said charge retentive surface to a copy substrate, wherein said intermediate transfer belt comprises a substrate comprising a polyimide and a lignin sulfonic acid doped polyaniline dispersion, wherein lignin sulfonic acid doped polyaniline is presenting the substrate in an amount of from about 1 to 50 percent by weight of total solids; and a fixing component to fuse said developed toner image to said copy substrate.

* * * * *